United States Patent [19]

Bobjer et al.

[11] Patent Number: 4,515,070

[45] Date of Patent: May 7, 1985

[54] VENTILATION METHOD AND APPARATUS

[76] Inventors: Olle Bobjer, Carl Barks väg 3, S-163 58 SPånga, Sweden; Torsten Dahlin, Jose Almeida Camargo 103, Sao Paulo SP CEP05436, Brazil; John Grieves, G:a Lundagatan 6 A, S-117 26 Stockholm, Sweden

[21] Appl. No.: 505,128

[22] Filed: Jun. 16, 1983

[51] Int. Cl.[3] ..... F24F 7/06

[52] U.S. Cl. ..... 98/42.07; 98/DIG. 7; 98/94.1

[58] Field of Search ..... 98/43 R, 50, 94 R, 115 R, 98/115 VM, DIG. 7; 169/91

[56] References Cited

U.S. PATENT DOCUMENTS

| | | | |
|---|---|---|---|
| 1,954,017 | 4/1934 | Manning | 98/99.6 |
| 2,348,455 | 5/1944 | Daudelin | 98/43 R |
| 2,480,441 | 8/1949 | Bingham | 98/43 R |
| 2,960,924 | 11/1960 | Grott | 98/94 R |

FOREIGN PATENT DOCUMENTS

| | | | |
|---|---|---|---|
| 2290228 | 6/1976 | France | 169/48 |
| 152024 | 5/1952 | Sweden . | |
| 354233 | 6/1961 | Switzerland | 98/DIG. 7 |
| 905491 | 2/1982 | U.S.S.R. | 98/50 |

*Primary Examiner*—Harold Joyce
*Attorney, Agent, or Firm*—Griffin, Branigan & Butler

[57] ABSTRACT

Method and apparatus for a mainly temporary ventilation of a room. A fan blows air from the room through an inflatable balloon, being placed in a permanent opening, e.g. a window, in a wall limiting the room. The balloon is provided with at least one exhaust opening being dimensioned so that an overpressure is built up inside the balloon sufficient to keep the balloon inflated and in abutment with the limitations of the opening.

5 Claims, 1 Drawing Figure

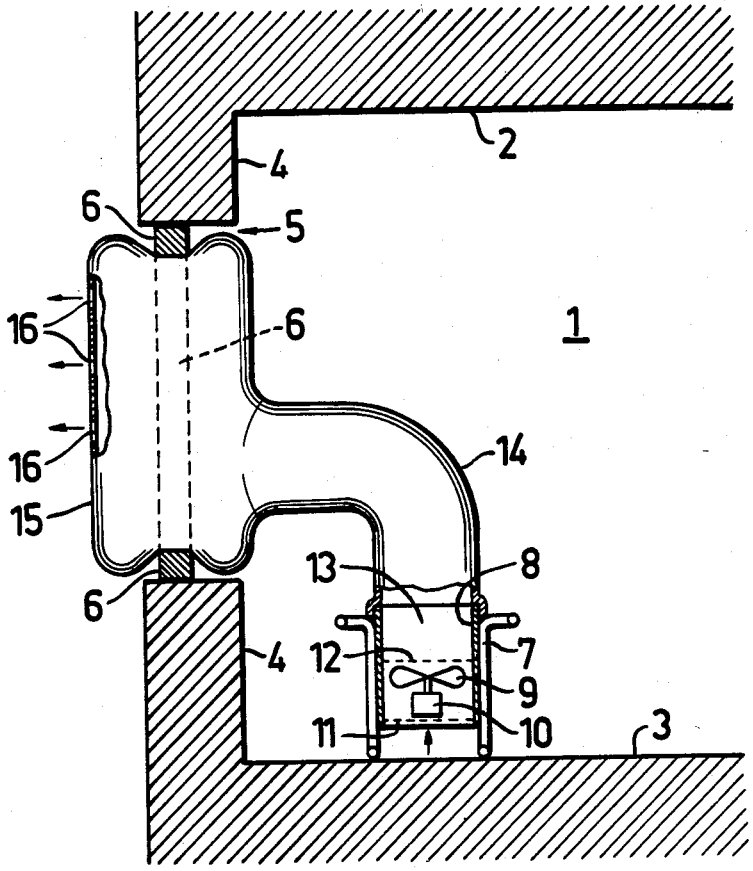
2
4
6
5
16
6
1
16
14
15
13
8
6
4
12
7
9
11
10
3

VENTILATION METHOD AND APPARATUS

The present invention relates to a method for mainly temporary ventilation of a room using a fan being arranged to transfer air from the room through an existing opening in a wall limiting the room. The invention also relates to an apparatus for the execution of said method.

A temporary, i.e. not permanent ventilation of a room here means e.g. ventilation of harmful solvents out from a room where paintwork is temporarily being undertaken.

A more and more observed problem in connection with paintworks consists in the volatile and often very harmful solvents used in a.o. paints. In order to prevent the concentration of solvents in the air from becoming too high an effective air exchange must be provided, which is normally achieved by opening a window and/or doors to create a draught. Apart from the fact that the direction of the draught is not controllable, such draught is known to bring discomfort to persons being subjected to same.

The object of the invention is to provide a method and an apparatus setting aside said problems as well as providing a controlled ventilation of a room through an open window or another opening in the room without appreciably influencing adjacent rooms.

In practicing the invention a fan is used for transport of the ventilating air. On its way from the room the ventilating air is brought to pass through a balloon placed in the opening, said balloon being arranged so that it is inflated and seals against the limiting edges of the opening and hereby separates the room from the space outside the same. From the fan is leading a flexible hose being connected to the side of the balloon facing the room. On the opposite side the balloon is preferably provided with exhaust holes being dimensioned in number and area so that the balloon is kept inflated to an extent sufficient to seal against the edges of the opening.

The drawing is a cross-sectional side view of a preferred embodiment of the invention.

In the drawing 1 refers to a room, which is to be ventilated, 2 to the ceiling of the room, 3 to its floor and 4 to a wall, preferably on outer wall being provided with a window 5 with a window frame 6.

On the floor 3 is standing a fan stand 7 in which is mounted a cylindrical fan housing 8. In the lower part of the fan housing an axial fan 9 with a driving motor 10 is provided. The fan housing is ended at the bottom with a net 11. Also above the fan is a net 12, on top of which is an empty space 13.

A flexible hose 14 is connected to the upper part of the fan housing, which hose leads to an inflatable balloon 15. The hose and the balloon could preferably be made from the same material—and also in one piece—e.g. from an essentially air tight textile, as so called spinnaker cloth. The hose and the balloon are stored in the space 13 when the apparatus is not in use.

The balloon 15 is placed in the window opening 5 and by means of the fan 9 inflated so that it abuts the window frame 6. From the balloon the ventilating air is led out through holes 16 in the outer wall of the balloon. Replacement air to the room 1 can be brought from adjacent rooms, stairways or the like.

By means of the described apparatus a room is ventilated through an open window opening being sealed by the balloon by means of the internal pressure of the exhaust air transported by the fan. Thus, the apparatus has the same function as if a fan were mounted into a board sealing the window opening, i.e. exhaust of air can be effected through the window opening without letting ambient atmosphere into the room. Apart from the advantages offered by the apparatus according to the invention, in comparison with such an arrangement, as a simple manner of handling, flexibility and adaptability, the low location of the fan 9 and the placement of the fan stand 7 on the floor, results in that the relatively heavy, gaseous solvents, which stay near the floor, are directly caught by the fan and blown out through the hose 14 and the balloon 15.

We claim:

1. A method for temporary ventilation of a room through an existing wall opening, said method comprising the step of:

blowing room air through a self-sustained sealing inflatable balloon installed in the existing wall opening wherein the exit of the blown air from the balloon takes place under a sufficient resistance to build an overpressure sufficient to inflate the balloon and maintain the balloon in self-sustained sealing connection with the existing wall opening.

2. An apparatus for ventilation of a room having an opening in a wall, comprising:

a room ventilating fan means; and, an inflatable balloon means having means for receiving room air and means for exhausting room air transferred by said fan means, said balloon means being placed in the wall opening and maintaining a substantially self-sustained sealing relation to the limitations of the wall opening by means of an overpressure built up in said balloon means by the room air transferred by said fan means.

3. An apparatus as described in claim 2 wherein:

said fan means includes a fan mounted in a fan housing; and, said balloon means for receiving room air from said fan means comprises a flexible hose connected to said fan housing.

4. An apparatus as described in claim 3 wherein said fan housing substantially has the shape of a straight circular cylinder and is supported by a stand being adapted to stand on the floor of the room and to keep said fan housing substantially vertical and spaced above the floor.

5. An apparatus as described in claim 4 wherein:

said fan is mounted in the lower part of said fan housing; and, a storage space means limited by a net is provided in said fan housing above said fan for storing said balloon means including said flexible hose when the apparatus is not in use.

* * * * *